United States Patent [19]

Lambert

[11] Patent Number: 4,946,585

[45] Date of Patent: Aug. 7, 1990

[54] METALS RECOVERY BY FLOTATION

[75] Inventor: Alexander S. Lambert, Lisvane Cardiff, United Kingdom

[73] Assignee: American Cyanamid Company, Stamford, Conn.

[21] Appl. No.: 408,582

[22] Filed: Sep. 18, 1989

[30] Foreign Application Priority Data

Dec. 1, 1988 [GB] United Kingdom ..... 8828065

[51] Int. Cl.[5] ..... B03D 1/008; B03D 1/01; B03D 1/012

[52] U.S. Cl. ..... 209/166; 252/61

[58] Field of Search ..... 209/166, 167; 252/61

[56] References Cited

U.S. PATENT DOCUMENTS

| | | | |
|---|---|---|---|
| 1,652,060 | 12/1927 | Smith | 209/166 |
| 1,716,104 | 6/1929 | Bolton | 209/166 |
| 1,780,000 | 10/1930 | Bolton | 209/166 |
| 1,788,585 | 1/1931 | Ney | 209/166 |
| 1,847,664 | 3/1932 | Ney | 209/166 |
| 1,852,107 | 4/1932 | Christman | 209/166 |
| 1,858,007 | 5/1932 | Falconer | 209/166 |
| 1,894,344 | 1/1933 | Christman | 209/166 |
| 2,029,156 | 1/1936 | Christman | 209/166 |
| 4,724,072 | 2/1988 | Bornengo | 209/166 |

FOREIGN PATENT DOCUMENTS

| | | | |
|---|---|---|---|
| 7412 | 5/1927 | Australia | 209/166 |

*Primary Examiner*—David L. Lacey
*Assistant Examiner*—Thomas M. Lithgow
*Attorney, Agent, or Firm*—Frank M. Van Riet

[57] ABSTRACT

Collector compositions for use in froth flotation processes for the beneficiation of gold and silver values from base metal sulfide ores are disclosed. The collector compositions comprise at least one mercaptobenzothiazole compound selected from compounds of the formula:

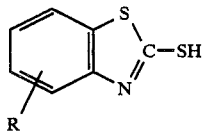

wherein R is a $C_1$–$C_8$ alkyl or a $C_2$–$C_8$ alkoxy radical. The use of the substituted mercaptobenzothiazole collectors provides excellent metallurgical recoveries of gold and silver values in froth flotation processes conducted over a broad range of pH conditions including acid, neutral and mildly alkaline pH.

5 Claims, No Drawings

METALS RECOVERY BY FLOTATION

BACKGROUND OF THE INVENTION

The present invention relates to froth flotation processes for recovery of metal values from base metal sulfide ores. More particularly, it relates to improved sulfide collectors comprising certain substituted mercaptobenzothiazole compounds which exhibit excellent metallurgical performance over a broad range of pH values.

Froth flotation is one of the most widely used processes for beneficiating ores containing valuable minerals and is described in U.S. Pat. No. 4,584,097, hereby incorporated herein by reference.

The success of a sulfide flotation process depends to a great degree on the reagent(s) called collector(s) that impart(s) selective hydrophobicity to the value sulfide mineral that has to be separated from other minerals. Thus, the flotation separation of one mineral species from another depends upon the relative wettability of mineral surfaces by water. Typically, the surface free energy is purportedly lowered by the adsorption of heteropolar collectors. The hydrophobic coating thus provided acts in this explanation as a bridge so that the mineral particles may be attached to an air bubble. The practice of this invention is not, however, limited by this or other theories of flotation.

Xanthates, dithiophosphates, alkyl xanthogen alkyl formates, bis alkyl xanthogen formates, dialkylthionocarbamates, hydrocarboxycarbonyl thionocarbamates, etc. have been shown to be useful collectors in froth flotation procedures. Most of these known collectors, however, are known to suffer from at least one deficiency which prevents them from being used universally for the recovery of metals from each and every ore requiring refining, such as pH dependency, affinity for some metals versus others etc.

The use of substituted mercaptobenzothiazoles as collectors for the recovery of lead and zinc oxides and carbonates is taught in U.S. Pat. No. 4,724,072. The collectors thereof are taught as capable of forming water-insoluble compounds with metals, the metal ion being bonded to the ionic molecule of the collector through ionic bonds as well as through a donor-type bond. The association between the metal and the collector occurs so that the coordination number and the electric charge of the metal are balanced respectively by the sum of the donor groups and of the ionic charge of the collector with which the metal combines.

The mechanism of adsorption of various mercaptobenzothiazoles on oxide or carbonate minerals is quite different from that on sulfide minerals. In sulfide systems, i.e. as per the instant invention, irrespective of the surface complex formed, the substituted mercaptobenzothiazoles must go through an oxidation step. The oxidation products (a dimer and/or metal thiazole complex) are the adsorbing species on minerals, such as pyrite, chalcopyrite, chalcocite or galena. The substituted mercaptobenzothiazoles oxidize more readily than other similar structures under a given set of conditions. This is attributable to the electron-donating tendency of the substituent group on the ring. The overall result is that the substituted mercaptobenzothiazoles are better collectors than mercaptobenzothiazole in flotation of sulfide minerals.

Accordingly, it is an object of the present invention to provide an improved sulfide collector and flotation process for the beneficiation of sulfide minerals employing froth flotation methods for the recovery of metals from ore, especially gold and silver.

SUMMARY OF THE INVENTION

In accordance with the present invention, there is provided a new and improved process for beneficiating an ore containing sulfide minerals with selective rejection of oxides and carbonates, said process comprising: grinding said ore to provide particles of flotation size, slurrying said particles in an aqueous medium, conditioning said slurry with effective amounts of a frothing agent and a metal collector, and frothing the desired sulfide minerals preferentially over gangue minerals by froth flotation procedures; said metal collector comprising at least one substituted mercaptobenzothiazole compound selected from compounds having the formula:

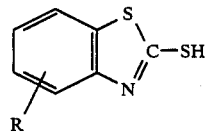

wherein R is a $C_1$–$C_8$ alkyl or $C_2$–$C_8$ alkoxy radical.

In particularly preferred embodiments, a new and improved method for enhancing the recovery of gold and silver minerals from an ore containing a variety of sulfide minerals is provided.

The present invention therefore provides a new and improved process for froth flotation of base metal sulfide ores. The substituted mercaptobenzothiazole collectors and the process of the present invention unexpectedly provide superior metallurgical recovery in froth flotation separations as compared with many conventional sulfide collectors, even at reduced collector dosages, and are effective under conditions of acid, neutral or mildly alkaline pH. In accordance with the present invention, a sulfide ore froth flotation process is provided which provides for superior beneficiation of sulfide mineral values.

Other objects and advantages of the present invention will become apparent from the following detailed description and illustrative working examples.

DETAILED DESCRIPTION OF THE INVENTION

In accordance with the present invention, sulfide metal and mineral values are recovered by froth flotation methods in the presence of a novel sulfide collector, said collector comprising at least one substituted mercaptobenzothiazole compound of the above formula. The R radicals may be unsubstituted or optionally substituted by polar groups, such as halogen, nitrile or nitro groups, and may independently be selected from methyl, ethyl, propyl, n-butyl, t-butyl, isobutyl, n-hexyl, cyclohexyl, heptyl, octyl, ethoxy, propoxy, n-butoxy, t-butoxy, isobutoxy, pentoxy, heptoxy, n-hexoxy, cyclohexoxy, octyloxy groups.

In preferred embodiments, the substituted mercaptobenzothiazole collectors of the above formula employed are those compounds wherein R is $C_1$–$C_4$ alkyl or $C_2$–$C_4$ alkoxy radicals, and especially preferably are ethoxy, butoxy, methyl and butyl radicals.

Illustrative compounds within the above formula for use as sulfide collectors in accordance with the present invention include:

6-methyl-2-mercaptobenzothiazole,
6-ethyl-2-mercaptobenzothiazole,
6-butyl-2-mercaptobenzothiazole,
6-octyl-2-mercaptobenzothiazole,
5-methyl-2-mercaptobenzothiazole,
6-ethoxy-2-mercaptobenzothiazole,
6-butoxy-2-mercaptobenzothiazole,
5-octyloxy-2-mercaptobenzothiazole, and the like.

The substituted 2-mercaptobenzothiazole compounds of the present invention may be conveniently prepared as described in U.S. Pat. No. 4,724,072, hereby incorporated herein by reference.

In accordance with the present invention, the above-described substituted-2-mercaptobenzothiazoles are employed as sulfide collectors in a new and improved froth flotation process which provides a method for enhanced beneficiation of sulfide mineral values from base metal sulfide ores over a wide range of pH values and more particularly under acidic, neutral, slightly alkaline and highly alkaline conditions.

In accordance with the present invention, the new and improved, essentially pH-independent process for the beneficiation of mineral values from base metal sulfide ores comprises, firstly, the step of size-reducing the ore to provide ore particles of flotation size. Generally, and without limitation, suitable particle size will vary from between about 50 mesh to about 800 mesh sizes. Preferably, the ore will be size-reduced to provide flotation sized particles of between about −65 mesh and about +400 mesh. Especially preferably for use in the present method are base metal sulfide ores which have been size-reduced to provide from about 14% to about 30% by weight of particles of +200 mesh and from about 45% to about 75% by weight of particles of −400 mesh sizes.

Size reduction of the ores may be performed in accordance with any method known to those skilled in this art.

Preadjustment of pH is conveniently performed by addition of the modifier to the grind during the size reduction step.

The pH of the pulp slurry may be pre-adjusted to any desired value by the addition of either acid or base, and typically sulfuric acid or lime are used for this purpose, respectively. Thus, for example, good beneficiation has been obtained in accordance with the process of the present invention at pH values ranging between 3.5 and 11.0, and especially good beneficiation has been observed with pH values within the range of from about 4.0 to about 10.0 pH.

The size-reduced ore, e.g., comprising particles of liberation size, is thereafter slurried in aqueous medium to provide a floatable pulp. The aqueous slurry or pulp of flotation sized ore particles, typically in a flotation apparatus, is adjusted to provide a pulp slurry which contains from about 10 to 60% by weight of pulp solids, preferably 25 to 50% by weight and especially preferably from about 30% to about 40% by weight of pulp solids.

In accordance with a preferred embodiment of the process of the present invention, the flotation of gold and silver sulfide is performed at a pH of less than or equal to 6.0 and preferably less than 4.0. It has been discovered that in conducting the flotation at this pH, the substituted mercaptobenzothiazole collectors of the present invention exhibit exceptionally good collector strength, together with excellent collector selectivity, even at reduced collector dosages. Accordingly, in this preferred process, sulfuric acid is used to bring the pH of the pulp slurry to less than or equal to 6.0.

After the pulp slurry has been prepared, the slurry is conditioned by adding effective amounts of a frothing agent and a collector comprising at least one substituted mercaptobenzothiazole compound as described above. By "effective amount" is meant any amount of the respective components which provides a desired level of beneficiation of the desired metal values. Generally, about 0.005 to about 0.5 lb. of collector per ton of ore is sufficient.

Any known frothing agent may be employed in the process of the present invention. By way of illustration such frothing agents as straight or branched chain low molecular weight hydrocarbon alcohols, such as $C_6$ to $C_8$ alkanols, 2-ethyl hexanol and 4-methyl-2-pentanol, also known as methyl isobutyl carbinol (MIBC) may be employed, as well as pine oils, cresylic acid, polyglycol or monoethers of polyglycols and alcohol ethoxylates, to name but a few of the frothing agents which may be used as frothing agent(s) herein. Generally, and without limitation, the frothing agent(s) will be added in conventional amounts and amounts of from about 0.01 to about 0.2 pounds of frothing agent per ton or ore treated are suitable.

Thereafter, the conditioned slurry, containing an effective amount of frothing agent and an effective amount of collector, is subjected to a frothing step in accordance with conventional froth flotation methods to float the desired sulfide mineral values in the froth concentrate and selectively reject or depress other gangue minerals.

The improved collectors of the present invention may be added to the flotation cell as well as to the grind.

The collectors of the present invention have been described for use in those applications wherein it is desired to selectively concentrate or collect certain metal value sulfides, mainly those containing gold and silver from gangue materials, e.g., silicates, carbonates, oxides, etc.

The collectors of the present invention may be used alone or in conjunction with such compounds as dithiophosphates, dithiophosphimates, mercaptobenzothiazole, and the like, in amounts up to about 60.0%, by weight, based on the total weight of the mercaptobenzothiazole represented in the formula above, preferrably up to about 40%, by weight, same basis.

The following examples are set forth for purposes of illustration only and are not to be construed as limiting the instant invention except as set forth in the appended claims. All parts and percentages are by weight unless otherwise specified. The dosage of collector is indicated on GPT, grams per ton.

EXAMPLE I

Samples, received as either damp preground solids or as high density pulp, are treated as follows:

1. Preground solids are repulped to 50% solid by mass with water.
2. The pulp is mechanically stirred, the pH is measured, and sulphuric acid is added to achieve a stable pH of 3.8.
3. The pulp is conditioned for 30 minutes as in Step 2.

4. The resultant conditioned pulp is transferred to a Denver D12 flotation machine and diluted with water to the flotation density of 33% solid by mass.
5. The flotation machine is set to 1300 rpm.
6. Reagents are added:
   (a) modifier-Guar gum depressant
   (b) collector
   (c) frother-polypropylene glycol
7. The resultant pulp is conditioned for 1 minute.
8. Copper sulfite modifier is added, and conditioning is continued for 30 seconds.
9. Air flow is commenced and set to 8 lpm, the froth is allowed to stabilize, and the first flotation concentrate (RC1) is collected for 1 minute.
10. The second flotation concentrate (RC2) is collected for 2 minutes.
11. The third flotation concentrate (RC3) is collected for 7 minutes.
12. The gas flow is closed and the fractions are analyzed.

The results are set forth in the following Tables.

TABLE I

A. Gold Mine No. 1 Tailings - DAM Reclamation

| Collector | GPT-Real (g/ton) | Recovery Au/ RC1 | Recovery Ag % RC2 | Recovery S % RC2 | Grade S RC2 |
|---|---|---|---|---|---|
| MBT | 38 | 10.4 | 16.4 | 81.6 | 15.7 |
| 6-EOMBT | 38 | 19.4 | 25.7 | 85.3 | 15.1 |

B. Gold Mine No. 2 Tailings - DAM Reclamation

| | | Recovery % - Au & Ag | | |
|---|---|---|---|---|
| | | RC1 | RC2 | RC3 |
| MBT | 50 | 30.5 | 45.0 | 54.5 |
| MBT/DTP | 50 | 35.2 | 54.6 | 57.1 |
| 6-EOMBT | 50 | 45.3 | 59.0 | 64.7 |

C. Gold Mine No. 3 Tailings - DAM Reclamation

| | GPT(Real) | Recovery Au/Ag RC1 | Recovery Au/Ag RC2 | Grade/ Sulphur RC1 |
|---|---|---|---|---|
| MBT/DTP #1 | 40 | 14.2 | 62.9 | 38.2 |
| 6-EOMBT/DTP #1 | 40 | 13.7 | 64.6 | 38.2 |
| MBT/DTP #2 | 40 | 8.4 | 56.5 | 41.9 |
| 6-EOMBT/DPT #2 | 40 | 9.2 | 59.6 | 41.8 |

MBT = mercaptobenzothiazole
6-EOMBT = 6-ethoxymercaptobenzothiazole
DTP = disobutyl dithiophosphate The data in Section A of Table I demonstrates the significant increase in rate of overall recovery while the data in Section B shows the improvement in the rate of recovery and overall recovery when compared to two (2) recognized standards. In Section C, compared to the two (2) recognized standards in this type of flotation, the collector of the present invention demonstrates significant increases in both rate of recovery and overall recovery as virtually identical sulphur grades.

EXAMPLE II

In this example, the following flotation procedure is followed:

The pulp Specific Gravity (SG) is adjusted to 1.3 using dilution water and the pH is adjusted to 4.0 using 10% $H_2SO_4$ or lime, as the case need be. The pH and SG conditioning is conducted for 30 minutes in an air agitated pochua. All SG checks are made using a Mettler balance. 13.4 Liters of the pulp are transferred to a 14 liter cell providing 2.4 liters for 2 head sampled and 11 liters for the test.

The cell, containing 13.4 liters of pulp, is placed under the D12 machine and agitated at 1800 rpm (air off) while two (2) 1.2 liter head samples are taken. The speed is slowed to 1500 rpm and the reagents are added simultaneously using microsyringes. The reagent additions for the float are:

| | | |
|---|---|---|
| (1) | Sodium mercaptobenzothiazole | 90 g/ton |
| (2) | Polypropylene glycol | 17 g/ton |
| (3) | 23.5 parts of s-butyldithio-phosphate - 15.5 parts water 100 part sodium hydroxide | 10 g/ton |
| (4) | Copper sulfate | 25 g/ton |
| (5) | Guar gum-depressant | as required |

The reagents are conditioned for 20 seconds at 1500 rpm (air off) and the air is then fully opened and the speed set to 1550 rpm. The first scrape is made at 10 seconds and additional scrapes are taken every 10 seconds thereafter using a fixed scraper. The following concentrates are taken:

| | | |
|---|---|---|
| Concentrate #1: | 4 scrapes every 10 seconds | 0.67 min. |
| Concentrate #2: | 10 scrapes every 10 seconds | 2.5 min. |
| Concentrate #3: | scraping takes place every 10 seconds for 6 minutes | 8.5 min. |
| Concentrate #4: | scraping takes place every 10 seconds for 9 minutes. | 17.5 min. |

The scraper and cell sides are washed after every scrape. After the final concentrate is recovered, the air is turned off and the speed is increased to 1800 rpm.

Two (2) 1.2 liter tails samples are then taken after the froth has settled. Concentrates, head and tails samples are prepared and assayed, the remaining tails pulp is filtered, dried and weighed and the total tails weight is calculated from these tails and the two (2) tails samples.

Various compounds falling within the scope of the instant claims are employed as collectors. On this ore, the minimum required sulphur grade is 29%. The results are set forth in the following tables.

TABLE II (COMPARISON OF MERCAPTOBENZOTHIAZOLES)

| Collector* | GPT | (Recovery vs. Grade) Recovery Gold - % | Grade Sulphur - % |
|---|---|---|---|
| 6-MMBT | 20 | 14.0; 24.5; 33.5 | 25.0; 22.0; 16.0 |
| 6-BMBT | 20 | 17.5; 27.5; 37.0 | 22.0; 18.0; 15.0 |
| 5-MMBT | 20 | 14.5; 21.5; 19.0 | 23.0; 19.0; 16.0 |
| 6-MOMBT*** | 20 | 4.0; 4.7; 13.0 | 4.0; 4.0; 4.0 |
| 6-BOMBT | 20 | 10.0; 14.5; 19.0 | 15.0; 14.0; 13.0 |
| 6-EOMBT | 20 | 11.0; 21.0; 32.0 | 37.0; 27.5; 19.0 |
| MBT | 20 | 16.5; 24.0; 26.8 | 23.0; 21.0; 19.5 |
| 6-MMBT | 10 | 8.0; 14.5; 22.0 | 24.0; 22.0; 18.8 |
| 6-BMBT | 10 | 13.5; 21.5; 27.5 | 32.5; 26.0; 22.0 |
| 5-MMBT | 10 | 2.5; 6.0; 8.0 | 31.5; 32.5; 26.0 |
| 6-MOMBT*** | 10 | 3.0; 7.0; 13.5 | 4.0; 4.0; 5.0 |
| 6-BOMBT | 10 | 14.5; 21.5; 33.0 | 32.0; 26.0; 23.0 |
| 6-EOMBT | 10 | 11.0; 19.0; 28.0 | 38.0; 30.0; 22.5 |
| MBT | 10 | 11.5; 18.8; 27.4 | 18.0; 20.0; 16.5 |

GOLD

| Collector* | GPT | (Recoverv vs. Grade) Recovery Gold - % | Grade Gold - % |
|---|---|---|---|
| 6-MMBT | 20 | 14.0; 24.5; 34.0 | 5.5; 5.1; 4.5 |
| 6-BMBT | 20 | 18.0; 28.0; 37.0 | 6.5; 5.5; 4.5 |
| 5-MMBT | 20 | 19.0; 16.5; 24.0 | 5.8; 4.5; 3.9 |
| 6-MOMBT*** | 20 | 4.0; 7.5; 13.0 | 3.4; 3.0; 2.7 |
| 6-BOMBT | 20 | 10.0; 14.0; 19.0 | 3.4; 3.6; 3.5 |
| 6-EOMBT | 20 | 11.0; 21.5; 32.0 | 6.7; 6.5; 5.3 |
| MBT | 20 | 12.0; 18.5; 27.0 | 5.5; 5.4; 5.3 |

TABLE II-continued (COMPARISON OF MERCAPTOBENZOTHIAZOLES)

| | | | |
|---|---|---|---|
| 6-MMBT | 10 | 8.0; 15.0; 21.5 | 6.3; 5.4; 5.4 |
| 6-BMBT | 10 | 13.0; 22.0; 28.5 | 6.7; 6.5; 5.6 |
| 5-MMBT | 10 | 2.5; 6.0; 8.0 | 6.8; 5.9; 5.3 |
| 6-MOMBT*** | 10 | 3.0; 7.0; 13.0 | 3.0; 3.3; 3.6 |
| 6-BOMBT | 10 | 14.0; 21.5; 33.5 | 6.4; 6.5; 6.9 |
| 6-EOMBT | 10 | 11.0; 19.5; 29.0 | 6.2; 5.9; 5.2 |
| MBT | 10 | 16.5; 24.0; 27.5 | 4.2; 4.3; 4.0 |

GOLD (Recovery vs. Mass to Concentrate)

| Collector* | GPT | Recovery Gold - % | MTC** - % |
|---|---|---|---|
| 6-MMBT | 20 | 14.0; 23.5; 33.5 | 1.0; 1.6; 3.1 |
| 6-BMBT | 20 | 23.0; 27.0; 37.5 | 1.0; 1.4; 3.1 |
| 5-MMBT | 20 | 9.0; 16.0; 23.0 | 0.7; 1.5; 2.9 |
| 6-MOMBT*** | 20 | 3.8; 7.0; 13.0 | 0.5; 1.0; 1.8 |
| 6-BOMBT | 20 | 9.5; 14.5; 18.5 | 2.3; 3.2; 4.2 |
| 6-EOMBT | 20 | 10.0; 21.0; 31.5 | 0.6; 1.3; 2.7 |
| MBT | 20 | 11.0; 18.5; 27.0 | 1.0; 1.5; 2.4 |

| Collector* | | GPT | Gold Recovery at 29% Sulphur | Max Gold Recovery |
|---|---|---|---|---|
| Run #1 | MBT | 38 | 29% not achieved | 26.95 |
| | EOMBT | 38 | 18.4 | 40.71 |
| Run #2 | MBT | 38 | 37.33 | 55.18 |
| | EOMBT | 38 | 41.06 | 62.17 |

*all as sodium salts
**Mass to concentrate
***comparative
6-MMBT = 6-methylmercaptobenzothiazole
6-BMBT = 6-butylmercaptobenzothiazole
5-MMBT = 5-methylmercaptobenzothiazole
6-MOMBT = 6-methoxymercaptobenzothiazole
6-BOMBT = 6-butoxymethylmercaptobenzothiazole The above data clearly shows that the 6-methoxymercaptobenzothiazole is not a satisfactory collector for gold containing sulfides, demonstrating a performance below that of mercaptobenzothiazole per se.

EXAMPLE 3

(Comparative)

Following the procedure of Example 2, except that the ore used is from a different source, various differently substituted mercaptobenzothiazoles are used as collectors. The results are set forth in Table III, below.

TABLE III (Recovery vs. Mass to Concentrate)

| Collector* | GPT | Gold Recovery - % | MTC** - % |
|---|---|---|---|
| MBT | 20 | 13.5; 25.0; 37.5 | 1.2; 2.5; 3.6 |
| OHMBT | 20 | 7.0; 12.5; 20.0 | 1.1; 2.1; 3.3 |
| NMBT | 20 | 12.0; 22.0; 31.0 | 1.8; 3.2; 4.2 |
| CLMBT | 20 | 6.5; 12.5; 19.0 | 0.9; 2.1; 2.8 |

(Recovery vs. Gold Grade)

TABLE III-continued

| Collector* | GPT | Gold Recovery - % | Gold Grade - % |
|---|---|---|---|
| MBT | 20 | 14.0; 25.5; 37.5 | 4.5; 4.1; 4.2 |
| OHMBT | 20 | 7.0; 12.5; 20.5 | 2.5; 2.6; 2.5 |
| NMBT | 20 | 11.5; 22.0; 31.0 | 3.2; 3.6; 3.7 |
| CLMBT | 20 | 6.5; 12.5; 19.0 | 3.5; 3.3; 3.4 |

(Recovery vs. Sulphur Grade)

| Collector* | GPT | Gold Recovery - % | Sulphur Grade - % |
|---|---|---|---|
| MBT | 20 | 14.0; 25.0; 38.0 | 32.5; 27.0; 24.0 |
| OHMBT | 20 | 7.0; 13.0; 20.5 | 5.0; 5.0; 5.0 |
| NMBT | 20 | 12.0; 22.0; 31.0 | 28.5; 26.5; 22.5 |
| CLMBT | 20 | 6.5; 13.0; 19.0 | 5.5; 6.5; 7.5 |

OHMBT = 6-hydroxymercaptobenzothiazole
NMBT = 6-nitromercaptobenzothiazole
CLMBT = 6-chloromercaptobenzothiazole The above data clearly shows that these substituted mercaptobenzothiazoles, especially the 6-hydroxy and 6-chloro, do not float pyrite containing gold. Although the 6-nitro compound is almost as good as the MBT standard, it fails to reach the required 29% sulphur grade results necessary. The Mass to Concentrate data presented in Table III clearly shows that the gold recovery for the 6-hydroxy and 6-chloro compounds is linear, thus indicating recovery is a mass function.

What is claimed is:

1. In a froth flotation process for beneficiating a sulfide ore containing gold and/or silver comprising slurring liberation sized particles of said ore in an aqueous medium, conditioning said slurry with effective amounts of a frothing agent and a gold and/or silver collector, respectively, and frothing the desired gold and/or silver containing sulfide minerals in the froth by froth flotation methods, the improvement comprising: employing as the gold and/or silver collector, from about 0.005 to about 0.5 lbs./ton of ore, of at least one mercaptobenzothioazole compound having the formula:

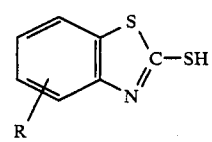

wherein R is a butyl or $C_2$–$C_8$ alkoxy radical.

2. A process as recited in claim 1, wherein said aqueous slurry of liberation-sized ore particles has a pH value of from about 3.5 to about 11.0, inclusive.

3. A process as recited in claim 1, wherein in said collector R is $C_2$–$C_8$ alkoxy.

4. A process as recited in claim 1, wherein in said collector R is ethoxy.

5. A process as recited in claim 1, wherein in said collector R is butoxy.

* * * * *